US008385793B2

(12) United States Patent
Furuya et al.

(10) Patent No.: US 8,385,793 B2
(45) Date of Patent: Feb. 26, 2013

(54) IMAGE FORMING APPARATUS PREVENTING GAPS BETWEEN A CONVEYOR BELT AND TRANSFER SHEET

(75) Inventors: Masaharu Furuya, Yokohama (JP); Masahiko Satoh, Machida (JP); Masanori Kawasumi, Yokohama (JP); Hirokatsu Suzuki, Zama (JP); Hirohmi Tamura, Yokohama (JP); Kazuya Saitoh, Sagamihara (JP); Takuya Suganuma, Ebina (JP); Mugijirou Uno, Isehara (JP); Shunichi Hashimoto, Yokohama (JP); Akira Shinshi, Machida (JP); Kazuhisa Sudo, Kawasaki (JP); Tomoko Takahashi, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 316 days.

(21) Appl. No.: 12/828,612

(22) Filed: Jul. 1, 2010

(65) Prior Publication Data

US 2011/0013950 A1 Jan. 20, 2011

(30) Foreign Application Priority Data

Jul. 16, 2009 (JP) ..... 2009-167331
Feb. 9, 2010 (JP) ..... 2010-026343

(51) Int. Cl.

| | |
|---|---|
| ***G03G 15/01*** | (2006.01) |
| ***G03G 15/20*** | (2006.01) |
| ***G03G 15/00*** | (2006.01) |
| ***G03G 21/16*** | (2006.01) |
| ***G03G 15/16*** | (2006.01) |

(52) U.S. Cl. ..... 399/302; 399/303; 399/308; 399/388; 399/66; 399/126

(58) Field of Classification Search ..... 399/302, 399/121, 303
See application file for complete search history.

(56) References Cited

U.S. PATENT DOCUMENTS 5,376,999 A * 12/1994 Hwang ..... 399/299
5,893,022 A * 4/1999 Yoshino et al. ..... 399/397
6,097,925 A * 8/2000 Nagaoka et al. ..... 399/316
(Continued)

FOREIGN PATENT DOCUMENTS

JP 10-55094 2/1998
JP 2006-251535 9/2006
(Continued)

*Primary Examiner* — David Gray
*Assistant Examiner* — Tyler Hardman
(74) *Attorney, Agent, or Firm* — Oblon, Spivak, McClelland, Maier & Neustadt, L.L.P.

(57) ABSTRACT

An image forming apparatus includes a first image carrier, a second image carrier, an intermediate transfer member disposed facing the second image carrier, a conveyance belt to transport a transfer sheet, disposed facing both the first image carrier and the intermediate transfer member, a first transfer member to transfer a first toner image formed on the first image carrier onto the transfer sheet, a second transfer member to transfer a second toner image formed on the second image carrier onto the intermediate transfer member, and a third transfer member disposed downstream from the second image carrier in a rotation direction of the intermediate transfer member, to transfer the second toner image from the intermediate transfer member onto the transfer sheet transported by the conveyance belt. The first image carrier and the intermediate transfer member inflect the conveyance belt at a first inflection angle and a second inflection angle, respectively.

12 Claims, 7 Drawing Sheets

U.S. PATENT DOCUMENTS

| | | | | |
|---|---|---|---|---|
| 6,516,179 | B1 * | 2/2003 | Sawai et al. | 399/388 |
| 6,947,682 | B2 | 9/2005 | Kosugi et al. | |
| 7,099,615 | B2 * | 8/2006 | Izumi | 399/316 |
| 7,155,152 | B2 | 12/2006 | Iwai et al. | |
| 7,369,800 | B2 * | 5/2008 | Izumi et al. | 399/317 |
| 7,574,153 | B2 | 8/2009 | Nakayama et al. | |
| 7,657,196 | B2 | 2/2010 | Yamaguchi et al. | |
| 7,672,605 | B2 | 3/2010 | Kayahara et al. | |
| 2001/0046389 | A1 * | 11/2001 | Kuribayashi et al. | 399/45 |
| 2002/0085864 | A1 * | 7/2002 | Abe | 399/299 |
| 2002/0122679 | A1 * | 9/2002 | Omata et al. | 399/309 |
| 2003/0113141 | A1 * | 6/2003 | Saito et al. | 399/302 |
| 2005/0047804 | A1 * | 3/2005 | Kosuge | 399/27 |
| 2006/0072929 | A1 * | 4/2006 | Takahashi | 399/13 |
| 2007/0014596 | A1 | 1/2007 | Sohmiya et al. | |
| 2007/0059071 | A1 | 3/2007 | Shinshi et al. | |
| 2008/0112734 | A1 | 5/2008 | Furuya et al. | |
| 2008/0118281 | A1 | 5/2008 | Saeki et al. | |
| 2008/0175621 | A1 | 7/2008 | Furuya et al. | |
| 2008/0304879 | A1 | 12/2008 | Tamura | |
| 2009/0279906 | A1 * | 11/2009 | Kuma et al. | 399/21 |
| 2009/0317104 | A1 * | 12/2009 | Katoh et al. | 399/49 |
| 2010/0003051 | A1 | 1/2010 | Sekina et al. | |
| 2010/0008696 | A1 | 1/2010 | Furuya et al. | |
| 2010/0040393 | A1 | 2/2010 | Kawahara et al. | |
| 2010/0061752 | A1 * | 3/2010 | Sudo et al. | 399/66 |
| 2010/0067952 | A1 | 3/2010 | Fujita et al. | |
| 2010/0080625 | A1 | 4/2010 | Furuya et al. | |
| 2012/0251199 | A1 * | 10/2012 | Miyazaki | 399/314 |

FOREIGN PATENT DOCUMENTS

| | | | |
|---|---|---|---|
| JP | 2007057715 | A * | 3/2007 |

* cited by examiner

IMAGE FORMING APPARATUS PREVENTING GAPS BETWEEN A CONVEYOR BELT AND TRANSFER SHEET

CROSS-REFERENCE TO RELATED APPLICATIONS

This patent specification is based on and claims priority from Japanese Patent Application Nos. 2009-167331, filed on Jul. 16, 2009, and 2010-026343, filed on Feb. 9, 2010, in the Japan Patent Office, the contents of which are hereby incorporated by reference herein in their entirety.

BACKGROUND OF THE INVENTION

1. Field of the Invention

The present invention generally relates to an electro photographic image forming apparatus such as a copier, a printer, a facsimile machine, or a multifunction machine capable of at least two of these functions, and more particularly, to an image forming apparatus including a conveyance belt to transport sheets of recording media (e.g., paper sheets, resin sheets, and the like) on which toner images are formed.

2. Discussion of the Background Art

Electro photographic intermediate transfer image forming apparatuses generally includes a conveyance member to transport sheets of recording media, an image forming unit to form multiple different single-color toner images (e.g., yellow, magenta, cyan, and black toner images), and an intermediate transfer belt on which multiple single-color toner images are superimposed one on another. The conveyance member may be a conveyance belt disposed engaging the intermediate transfer belt.

For example, JP-H10-055094-A discloses an image forming apparatus in which the conveyance belt is disposed horizontally and the intermediate transfer belt is disposed vertically. In this image forming apparatus, although yellow, magenta, and cyan images are superimposed one on another on the intermediate transfer belt, a photoconductor on which a black toner image is formed is disposed facing not the intermediate transfer belt but the conveyance belt, so that the black toner image is transferred from the photoconductor directly onto transfer sheets carried on the conveyance belt. This image forming apparatus can reduce required time for multicolor image formation while preventing or alleviating deterioration of image quality as well as scattering of toner, thus preventing image failure.

However, in this image forming apparatus, because the photoconductor for black and the intermediate transfer belt are positioned in contact with a linear portion of the conveyance belt, it is possible that the transfer sheet carried on the conveyance belt may fail to adhere to the conveyance belt fully when not transported smoothly, thus creating tiny gaps between the transfer sheet and the conveyance belt. If tiny gaps are thus created, electrical discharging can occur, which disturbs the toner image formed on the transfer sheet, resulting in substandard images.

In view of the foregoing, the inventors of the present invention recognize that there is a need for image forming apparatuses to prevent creation of tiny gaps between the transfer sheet and the conveyance belt, which known approaches fail to do.

SUMMARY OF THE INVENTION

In view of the foregoing, in one illustrative embodiment of the present invention, an image forming apparatus includes a first image carrier on which a first toner image is formed, a second image carrier on which a second toner image is formed, an intermediate transfer member disposed facing the second image carrier, a conveyance belt to transport a transfer sheet, disposed facing both the first image carrier and the intermediate transfer member and winding around at least a first support roller and a second support roller, a first transfer member disposed facing the first image carrier via the conveyance belt, a second transfer member disposed facing the second image carrier, and a third transfer member disposed downstream from the second image carrier in a direction in which the intermediate transfer member rotates. The first transfer member transfers the first toner image from the first image carrier onto the transfer sheet transported by the conveyance belt. The second transfer member primarily transfers the second toner image from the second image carrier onto the intermediate transfer member, which transports the second toner image to the third transfer member, and then the third transfer member transfers the second toner image from the intermediate transfer member onto the transfer sheet transported by the conveyance belt. The first image carrier inflects the conveyance belt at a first inflection angle, and the intermediate transfer member inflects the conveyance belt at a second inflection angle.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
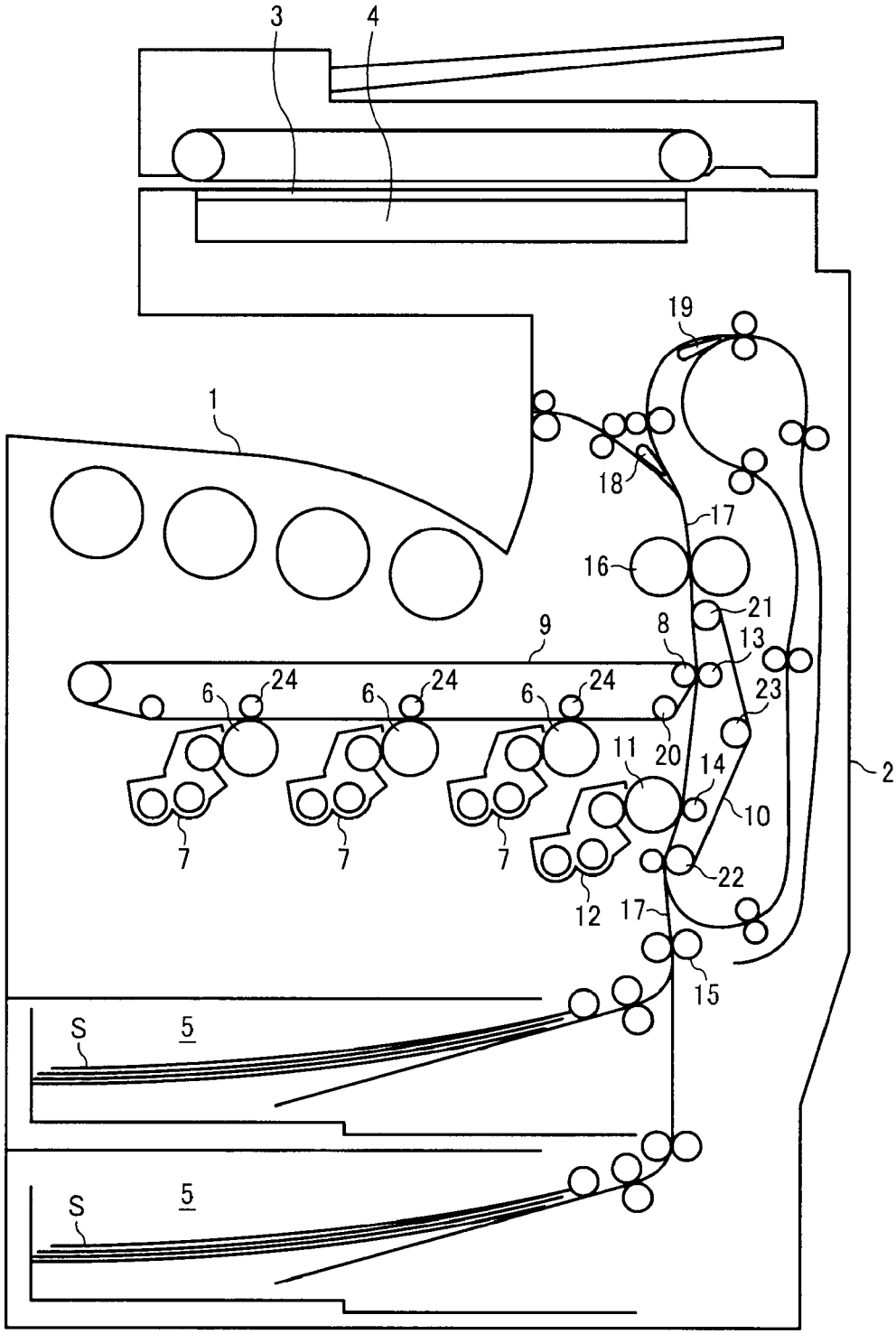
FIG. 1 is a schematic view illustrating an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described.

FIG. 1 is a schematic view illustrating an image forming apparatus according to an illustrative embodiment.

The image forming apparatus shown in FIG. 1 is a housing-internal discharge type, that is, a side of a housing thereof is partly recessed and a sheet discharge tray is disposed in the recessed portion, and is capable of forming multicolor images using an electro photographic image forming method.

Before certain distinctive features of the present embodiment, that is, configurations around a conveyance belt to transport sheets of recording media (e.g., transfer sheets), such as paper, resin film, and the like, on which toner images are formed, are described, a schematic configuration of the image forming apparatus is described below with reference to FIG. 1.

Referring to FIG. 1, the image forming apparatus according to the present embodiment includes a housing 2 that forms the sheet discharge tray 1 and supports respective components provided therein, an image reading unit 4, multiple sheet trays 5 disposed in a lower portion of the apparatus, each containing transfer sheets S, a first image forming unit 12 including a first photoconductor 11 (first image carrier), three second image forming units 7 arranged in a horizontal row at given constant intervals in a center portion of the apparatus, an intermediate transfer belt 9 (intermediate transfer member), a conveyance belt 10 disposed facing the first photoconductor 11 and the intermediate transfer belt 9, a secondary-transfer roller 13 (a third transfer member) disposed facing a secondary-transfer facing roller 8 via the intermediate transfer belt 9 and the conveyance belt 10, and a transfer roller 14 (a first transfer roller) facing the first photoconductor 11 via the conveyance belt 10. The image reading unit 4 includes a contact glass 3 and optically reads image data of a document placed on the contact glass 3. Each of the three second image forming units 7 includes a second photoconductor drum 6 (a second image carrier). The intermediate transfer belt 9 is stretched around primary-transfer rollers 24 (second transfer rollers) disposed facing the respective second photoconductor drums 6, the secondary-transfer facing roller 8, and other support rollers including a driven roller 20. The conveyance belt 10 transports the transfer sheet S upward in FIG. 1 and is stretched around the transfer roller 14 and multiple rollers including rollers 21, 22, and 23. In the first image forming unit 12, the first photoconductor 11 engages the conveyance belt 10 beneath the intermediate transfer belt 9.

The image forming apparatus further includes a pair of registration rollers 15 disposed upstream from the conveyance belt 10 in a direction in which the transfer sheet S is transported (hereinafter "sheet conveyance direction"), a fixing device 16 disposed downstream from the conveyance belt 10 in the sheet conveyance direction, and a conveyance unit 17 including multiple guide plates, multiple conveyance rollers, switch pawls 18 and 19, and a pair of discharge rollers.

The registration rollers 15 forward the transfer sheet S to the conveyance belt 10, timed to coincide with image formation in the first image forming unit 12. The fixing device 16 fixes a toner image on the transfer sheet S. The conveyance unit 17 transports the transfer sheet S from the sheet tray 5 to the sheet discharge tray 1 via the conveyance belt 10 and the fixing device 16 and capable of reversing the transfer sheet S discharged from the fixing device 16 to transport the transfer sheet S again to a first transfer nip where the transfer roller 14 presses against the first photoconductor 11 via the conveyance belt 10 as well as a third transfer nip where the secondary-transfer roller 13 presses against the secondary-transfer facing roller 8 via the intermediate transfer belt 9 and the conveyance belt 10.

The above-described first image forming unit 12 forms black toner images on the first photoconductor 11 according to image data captured by the image reading unit 4 or transmitted from an external device. The second image forming units 7 form yellow, cyan, and magenta toner images on the respective second photoconductors 6 according to image data captured by the image reading unit 4 or transmitted from an external device.

It is to be noted that, although the three second image forming units 7 for forming yellow, cyan, and magenta toner images, respectively, are used in the present embodiment, the number of the second image forming units 7 and colors of toner used therein are not limited thereto.

In the image forming apparatus configured as described above, according to image data of the document placed on the contact glass 3, captured by the image reading unit 4, or image data transmitted from an external device, the first image forming unit 12 forms a latent image for black on the first photoconductor 11, and the second image forming units 7 form latent images for respective colors on the respective second photoconductors 6. Then, the first image forming unit 12 develops the latent image with black toner into a black toner image (e.g., a first toner image), and the second image forming units 7 develop the respective latent images with respective color toners into toner images (e.g., second toner images). It is to be noted that, in the present embodiment, monochrome images can be formed using only the first image forming unit 12, which will be described below.

The primary-transfer rollers 24 to each of which a transfer bias is applied sequentially transfer the second toner images formed in the respective second image forming units 7 onto the intermediate transfer belt 9 rotating counterclockwise in FIG. 1, and the respective second toner images are superimposed one on another on the intermediate transfer belt 9, forming a multicolor image thereon. The transfer bias (primary-transfer bias) has a polarity opposite that of the charged toner. The second toner images formed on the respective second photoconductors 6 are transferred onto the intermediate transfer belt 9 in respective second transfer nips where the second photoconductors 6 press against the respective primary-transfer rollers 24 via the intermediate transfer belt 9. The intermediate transfer belt 9 transports the second toner image toward the conveyance belt 10.

Along with the above-described operations, the conveyance unit 17 starts transporting the transfer sheet S stacked on the sheet tray 5. The registration rollers 15 sandwich and stop the transfer sheet S, and then forward the transfer sheet S to the conveyance belt 10, timed to coincide with image formation.

Then, the conveyance belt 10 rotating clockwise in FIG. 1 transports the transfer sheet S upward. A transfer bias having the opposite polarity to that of the toner is applied to the transfer roller 14, and then the transfer roller 14 transfers the first toner image formed on the first photoconductor 11 of the first image forming unit 12 onto the transfer sheet S transported by the conveyance belt 10.

Subsequently, the secondary-transfer roller 13 to which a transfer bias is applied transfers the superimposed second toner image from the intermediate transfer belt 9 and superimposes the second toner image on the first toner image on the transfer sheet S. Thus, a multicolor image is formed on the transfer sheet S. It is to be noted that, instead of applying the transfer bias to the secondary-transfer roller 13, alternatively, the transfer bias may be applied to the secondary-transfer facing roller 8 so that the toner image on the intermediate transfer belt 9 is transferred onto the transfer sheet S. Further, instead of the secondary-transfer roller 13, a contactless corona charger, or the like can be employed.

The conveyance belt 10 transports the transfer sheet S carrying the multicolor toner image to the fixing device 16, and the fixing device 16 fixes the multicolor toner image on the transfer sheet S with heat and pressure.

In single-sided printing, the transfer sheet S discharged from the fixing device 16 is discharged by the discharge rollers to the sheet discharge tray 1, and thus a sequence of operations is completed.

In double-sided printing, after the toner image is fixed on a first surface (e.g., a front surface) of the transfer sheet S, the transfer sheet S is reversed through a reverse path (not shown) by switching positions of the switch pawls 18 and 19 in the conveyance unit 17 as required. Then, the transfer sheet S is transported again to the conveyance belt 10 with a second surface (e.g., a back surface) of the transfer sheet S serving as a transfer surface onto which another toner image is transferred. Thus, double-sided printing is performed.

Next, a configuration around the conveyance belt 10, which is a distinctive feature of the present embodiment, is described below.

(First Embodiment)

Figure 2:
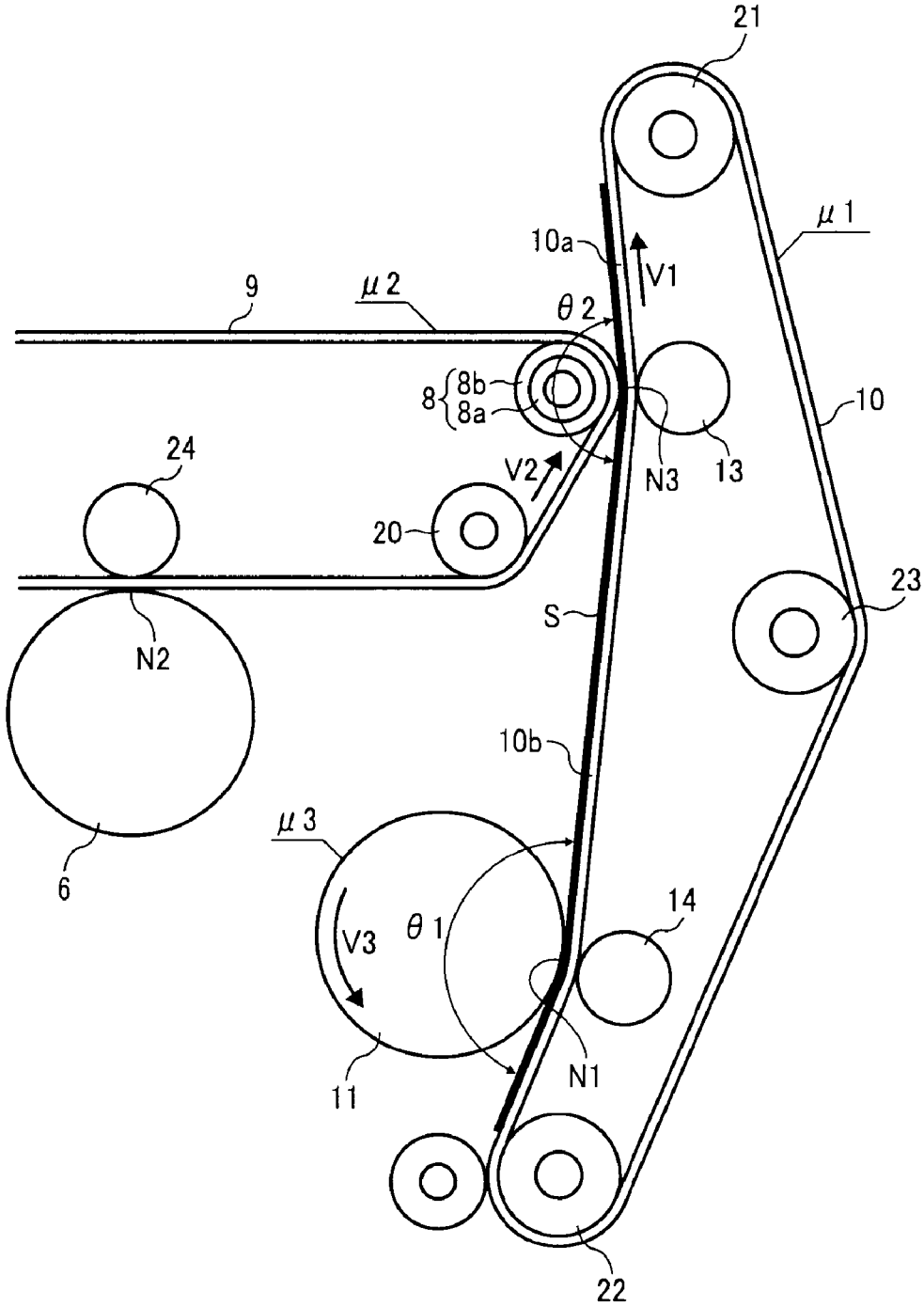
FIG. 2 is a front view schematically illustrating a configuration around a conveyance belt according to an illustrative embodiment.

FIG. 2 illustrates a configuration around the conveyance belt 10 according to a first embodiment. It is to be noted that, in FIG. 2, reference characters N1, N2, and N3 represent the first, second, and third transfer nips, respectively, and reference characters 10*a* and 10*b* represents a conveyance surface of the conveyance belt 10 in a portion downstream from the third transfer nip N3 and a portion between the first transfer nip N1 and the third transfer nip N3 in the sheet conveyance direction.

As shown in FIG. 2, the first photoconductor 11 and the intermediate transfer belt 9 are positioned adjacent to the conveyance belt 10. The rollers 21, 22, and 23, around which the conveyance belt 10 is stretched, serve as a driving roller, a driven roller, and a tension roller, respectively. The driving roller 21 is driven by a driving motor, not shown, and positioned between the fixing device 16 and the secondary-transfer facing roller 8. The driven roller 22 is positioned above and adjacent to the registration rollers 15. The tension roller 23 is positioned between the driving roller 21 and the driven roller 22 at the right thereof in FIG. 2, and a spring, not shown, urges the tension roller 23 outside the conveyance belt 10.

It is to be noted that the multiple rollers around which the conveyance belt 10 is stretched are not limited to those described above. For example, another driven roller may be provided at the right of the driving roller 21 and the driven roller 22, or the roller 21 may be a driven roller and one of other rollers may serve as a driving roller.

The first photoconductor 11 is positioned beneath and separate from the intermediate transfer belt 9 so that a side of the conveyance belt 10 facing the transfer sheet S (e.g., sheet conveyance side) is bowed or bent inward thereby. As described above, the transfer roller 14 presses against the first photoconductor 11 via the conveyance belt 10, thus forming the first transfer nip N1 in which the first toner image formed on the first photoconductor 11 is transferred onto the transfer sheet S carried on the conveyance belt 10.

In other words, the first photoconductor 11 bends the sheet conveyance side of the conveyance belt 10 inward at a first inflection angle θ1 so that the first transfer nip N1 can be formed to transfer the first toner image. The first inflection angle θ1 is preferably within a range of from 150° to 180° for standard sheets having a thickness of within a range 60 g/m$^2$ to 120 g/m$^2$, for example.

It is to be noted that the transfer roller 14 generates a transfer electrical field to transfer the first toner image from the first photoconductor 11 onto the transfer sheet S carried on the conveyance belt 10.

Among the multiple rollers around which the intermediate transfer belt 9 is stretched, the secondary-transfer facing roller 8 is positioned above and to the right of the driven roller 20 in FIG. 2, closer to the conveyance belt 10 than the driven roller 20. A portion of the intermediate transfer belt 9 winding around the secondary-transfer facing roller 8 bends the sheet conveyance side of the conveyance belt 10 inward. In addition, the secondary-transfer roller 13 presses against the secondary-transfer facing roller 8 via the intermediate transfer belt 9 and the conveyance belt 10, thus forming the third transfer nip N3 to transfer the second toner image formed on the intermediate transfer belt 9 onto the transfer sheet S carried on the conveyance belt 10.

In other words, the intermediate transfer belt 9 bends the sheet conveyance side of the conveyance belt 10 inward at an inflection angle θ2 so that the third transfer nip N3 can be formed to transfer the second toner image. Similarly to the first inflection angle θ1, the second inflection angle θ2 is preferably within a range of from 150° to 180° for standard sheets, for example.

Figure 3:
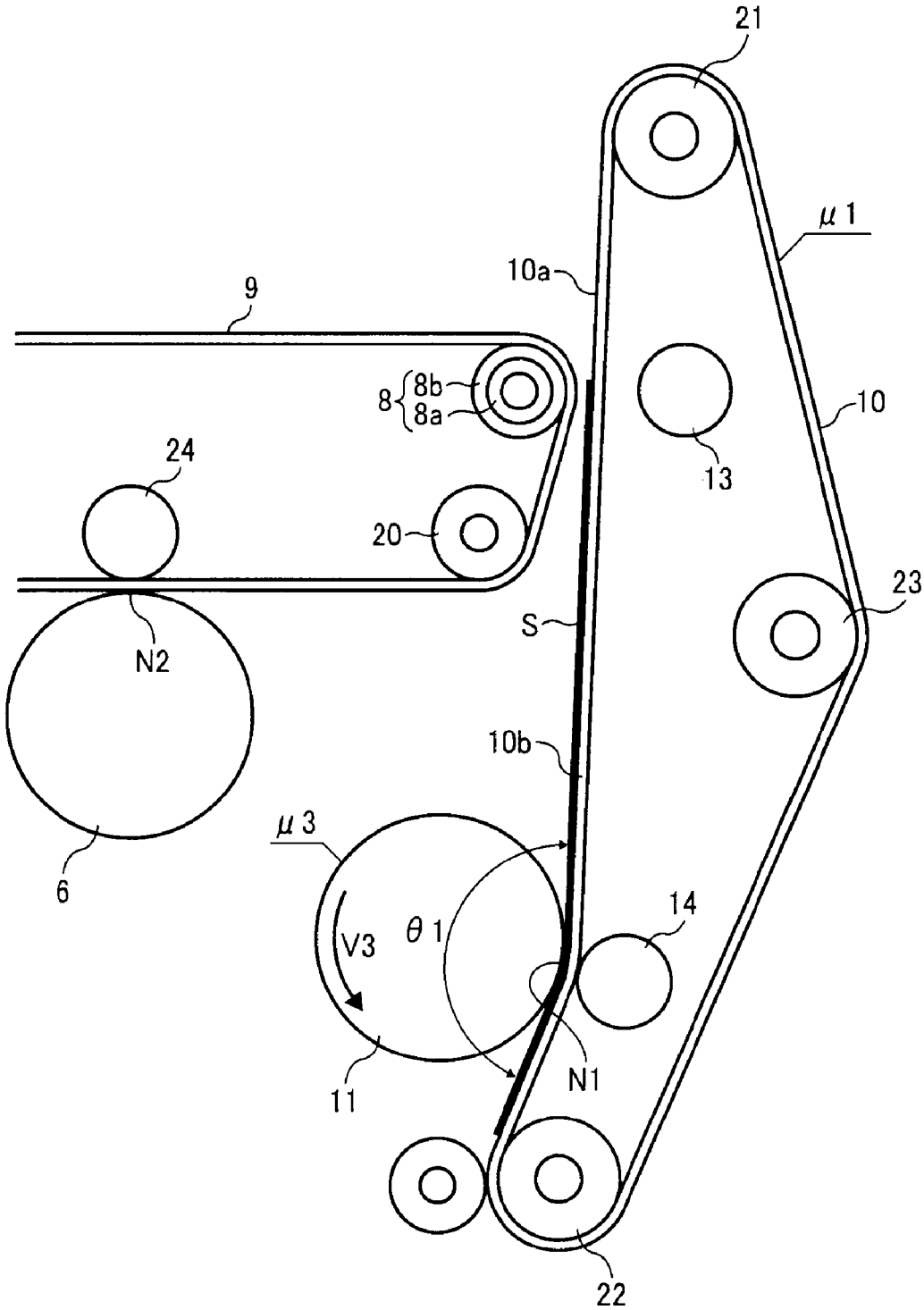
FIG. 3 is a front view schematically illustrating the configuration around the conveyance belt from which an intermediate transfer belt is disengaged.

Additionally, the secondary-transfer facing roller 8 is a driving roller driven by a driving motor, not shown, and is supported by a pivot able link, not shown, that can be pivoted laterally in FIG. 2 by a solenoid or a motor, not shown. With this configuration, the intermediate transfer belt 9 and the conveyance belt 10 can engage and disengage from each other. Because it is not necessary to operate the intermediate transfer belt 9 as well as the second photoconductors 6 to output monochrome images, the pivot able link pivots to the left in FIG. 2, thus disengaging the intermediate transfer belt 9 from the conveyance belt 10 as shown in FIG. 3. Although the first inflection angle θ1 is thus reduced slightly in monochrome printing, the first inflection angle θ1 preferably remains within a range of from 150° to 180° as well.

Figure 8:
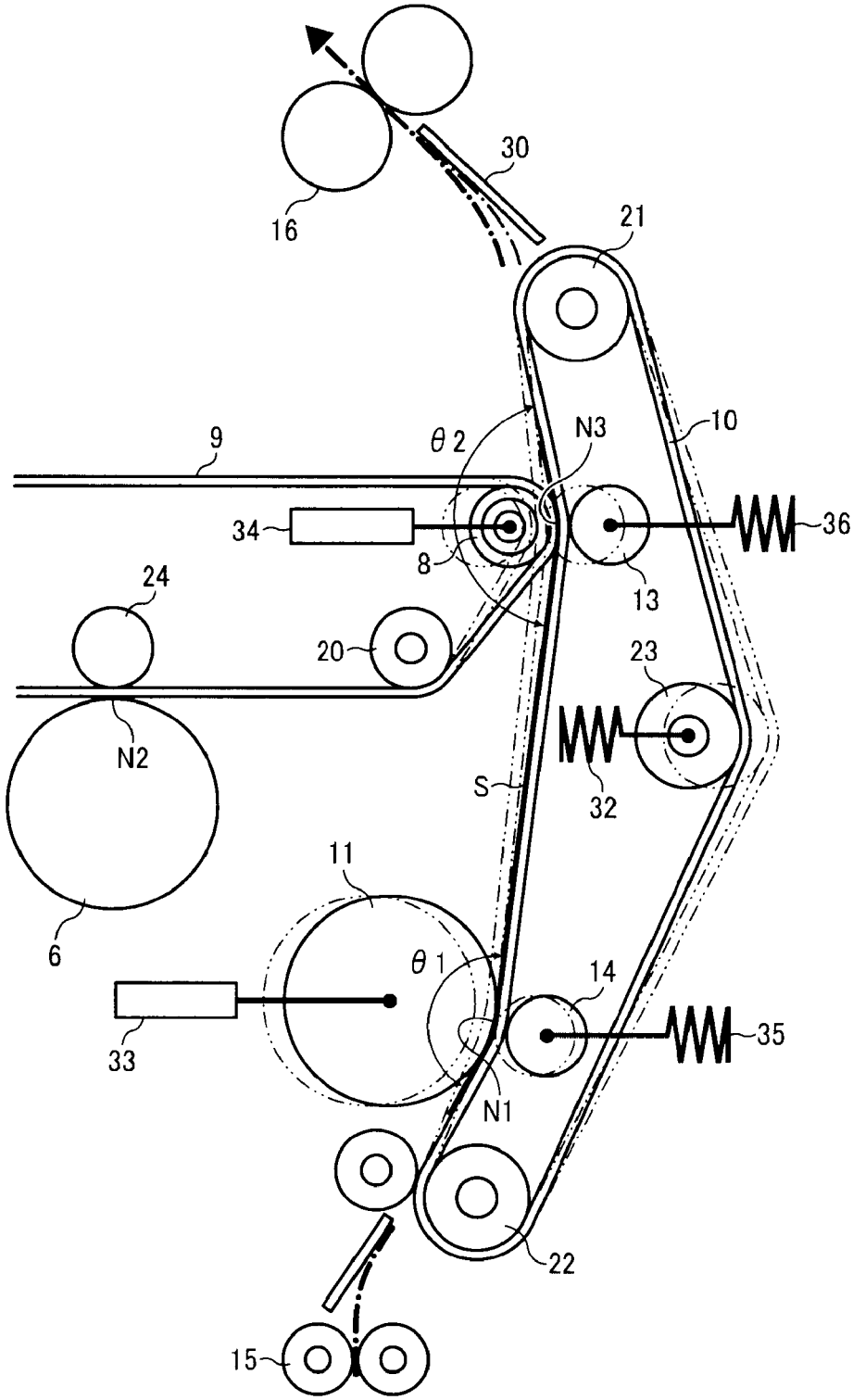
FIG. 8 is a front view schematically illustrating a configuration around a conveyance belt according to another illustrative embodiment.

It is to be noted that the shift mechanism to move the second-transfer facing roller 8 is not limited to the above-described link mechanism but can be a cam mechanism, a screw mechanism, a mechanism using a solenoid (such as shown in FIG. 8), or the like. Additionally, the intermediate transfer belt 9 may be disengaged from the conveyance belt 10 by moving the driving roller 21 as well as the secondary-transfer roller 13 to the right in FIG. 2, instead of moving the secondary-transfer facing roller 8 to the left in FIG. 2.

A conveyance velocity (linear velocity) V1 at which the conveyance belt 10 transports the transfer sheet S is faster than a conveyance velocity (linear velocity) V2 at which the intermediate transfer belt 9 rotates as well as a conveyance velocity (linear velocity) V3 at which the first photoconductor 11 rotates to an extent that the transfer sheet S can be transported reliably. For example, it is preferable that the ratio of the conveyance velocities V2 and V3 to the conveyance velocity V1 be 0.9 to 1.

Further, a surface frictional coefficient μ1 of the conveyance belt 10 is greater than surface frictional coefficients μ2 and μ3 of the intermediate transfer belt 9 and the first photoconductor 11, respectively, to an extent that the transfer sheet S can be transported reliably. For example, it is preferable that the surface frictional coefficient μ1 be within a range of from 0.3 to 0.8 and the surface frictional coefficients μ2 and μ3 be lower than 0.3 based on measurement according to Euler's theory.

Further, the secondary-transfer facing roller 8 includes a metal core 8*a* and an elastic layer 8*b* such as rubber surface layer over the metal core 8*a*, and thus the outer layer of the secondary-transfer facing roller 8 is elastically deformable. Moreover, the secondary-transfer roller 13 has a degree of hardness higher than that of the secondary-transfer facing roller 8. For example, it is preferable that the secondary-transfer roller 13 and the secondary-transfer facing roller 8 have a JIS-A hardness of 60° and an Asker-C hardness within a range of from 30° to 60°, respectively.

Next, actions and effects of the configuration around the conveyance belt according to the first embodiment are described below.

Initially, the transfer sheet S forwarded by the registration rollers 15 at the predetermined timing is transported while curved in conformity with the arced first photoconductor 11 and along the conveyance belt 10 at the first inflection angle θ1, projecting to the right in FIG. 2. At that time, the transfer sheet S closely adheres to the conveyance belt 10 with resilience due to its rigidity, that is, a force toward the right in FIG. 2 acts on both a leading end portion and a trailing end portion of the transfer sheet S on both sides of the first transfer nip N1 in the sheet conveyance direction.

Then, the transfer sheet S is transported further while conforming to the arced intermediate transfer belt 9 and along the conveyance belt 10 at the second inflection angle θ2, projecting to the right in FIG. 2 similarly. Also at that time, the transfer sheet S closely adheres to the conveyance belt 10 with resilience due to its rigidity, that is, a force toward the right in FIG. 2 acts on both the leading end portion and the trailing end portion of the transfer sheet S on both sides of the third transfer nip N3 in the sheet conveyance direction.

With this configuration, because the transfer sheet S can closely adhere to the conveyance belt 10, eliminating or reducing creation of tiny gaps between the conveyance belt 10 and the transfer sheet S, electrical discharging caused by such tiny gaps can be prevented, and accordingly image failure caused by such discharging can be prevented. In addition, in monochrome printing, because the first inflection angle θ1 of the conveyance belt 10, projecting to the right in FIG. 2, is kept within such a range that the transfer sheet S can adhere to the conveyance belt 10 closely as described above, the above-described actions and effects can be attained.

Further, the conveyance belt 10 rotates at the conveyance velocity V1, driven by the driving roller 21, while the intermediate transfer belt 9 rotates at the conveyance velocity V2, driven by the secondary-transfer facing roller 8. By setting the conveyance velocity V1 higher than the conveyance velocity V2 (V1>V2), the intermediate transfer belt 9 exerts a drag on the conveyance belt 10, thus preventing slackening or wavering of the conveyance surface 10*a* of the conveyance belt 10 downstream from the third transfer nip N3. As a result, image failure caused by electrical discharging can be prevented. Similarly, setting the conveyance velocity V1 of the conveyance belt 10 higher than the conveyance velocity V3 of the first photoconductor 11 (V1>V3) can prevent slackening or wavering of the conveyance surface 10*b* of the conveyance belt 10 positioned between the first transfer nip N1 and the third transfer nip N3, and thus image failure caused by such discharging can be prevented.

Further, because the surface frictional coefficient μ1 of the conveyance belt 10 is greater than the surface frictional coefficient μ2 of the intermediate transfer belt 9 (μ1>μ2), the transfer sheet S can be carried on the conveyance belt 10 constantly and thus transported reliably. Similarly, because the surface frictional coefficient μ1 of the conveyance belt 10 is greater than the surface frictional coefficient μ3 of the first photoconductor 11 (μ1>μ3), the transfer sheet S can be transported reliably. Therefore, image failure such as magnification error or the like can be prevented or reduced.

Figure 4:
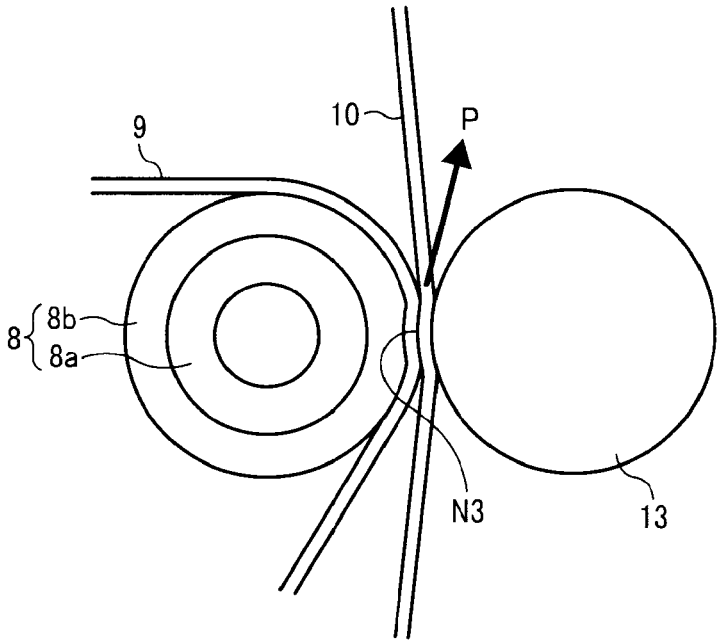
FIG. 4 is an enlarged front view illustrating a third transfer nip.

Further, because the secondary-transfer roller 13 has a degree of hardness greater than that of the secondary-transfer facing roller 8, the secondary-transfer facing roller 8 can deform inward (dent) in conformity with the shape of the secondary-transfer roller 13, and thus the third transfer nip N3 can be doubly curved as shown in FIG. 4. When the secondary-transfer facing roller 8 is dent, the transfer sheet S that has passed the third transfer nip N3 is discharged in a direction indicated by arrow P (hereinafter "discharge direction P") shown in FIG. 4, which is a direction in which the transfer sheet S adheres closely to the conveyance surface 10*a* (shown in FIG. 3) of the conveyance belt 10. Therefore, creation of tiny gaps between the conveyance belt 10 and the transfer sheet S can be eliminated or reduced, and accordingly image failure caused by electrical discharging can be prevented.

Further, because the secondary-transfer facing roller 8 is covered with the elastic layer 8*b* described above, the degree of deformation of the secondary-transfer facing roller 8 is relatively high and the secondary-transfer facing roller 8 can deform reliably. Therefore, the discharge direction P enables the transfer sheet S to adhere more closely to the conveyance surface 10*a* of the conveyance belt 10, thus eliminating or reducing the creation of tiny gaps between the transfer sheet S and the conveyance belt 10 and preventing image failure caused by electrical discharging.

As described above, in the configuration around the conveyance belt according to the first embodiment, the first inflection angle θ1 as well as the second inflection angle θ2 are substantially fixed although the first inflection angle θ1 decreases slightly in monochrome printing. By contrast, in second and third embodiments described below, the first inflection angle θ1 as well as the second inflection angle θ2 are adjustable according to the type of the transfer sheet S so that the transfer sheet S can adhere to the conveyance belt 10 fully.

Herein, referring to FIGS. 5 and 6, descriptions are given below of a relation between the inflection angle of the conveyance belt and the rate of occurrence of slippage of the transfer sheet S transported by the conveyance belt 10 (e.g., slip rate in transfer of transfer sheets).

Figure 5:
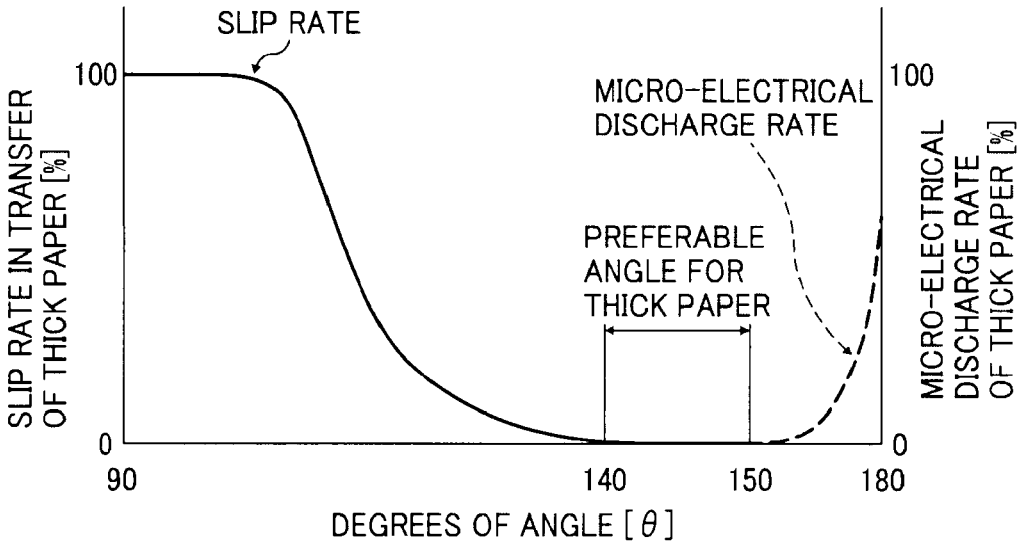
FIG. 5 is a graph illustrating a relation between the inflection angle of the conveyance belt and occurrence rate of slippage of thicker transfer sheets transported by the conveyance belt.

Referring to FIG. 5, a case in which the transfer sheet S is relatively thick such as cardboard is described below.

In the case of thicker sheets having a thickness of about 120 g/m$^2$ or greater, for example, as the inflection angle of the conveyance belt 10 decreases, slip rate in transfer of thicker sheets increases due to the rigidity of thicker sheets. By contrast, as the inflection angle increases, although slip rate in transfer of thicker sheets decreases as indicated by a solid line shown in FIG. 5, the degree of adhesion of thicker sheets to the conveyance belt 10 decreases, and thus micro-electrical discharging occurs as indicated by broken lines shown in FIG. 5. Therefore, in the case shown in FIG. 5 of thicker sheets, a preferable range of inflection angle of the conveyance belt 10 in which both slip rate in transfer of transfer sheets and occurrence of micro-electrical discharging are reduced is from 140° to 150°, for example.

By contrast, a case in which the transfer sheet S is relatively thin is described below with reference to FIG. 6.

Figure 6:
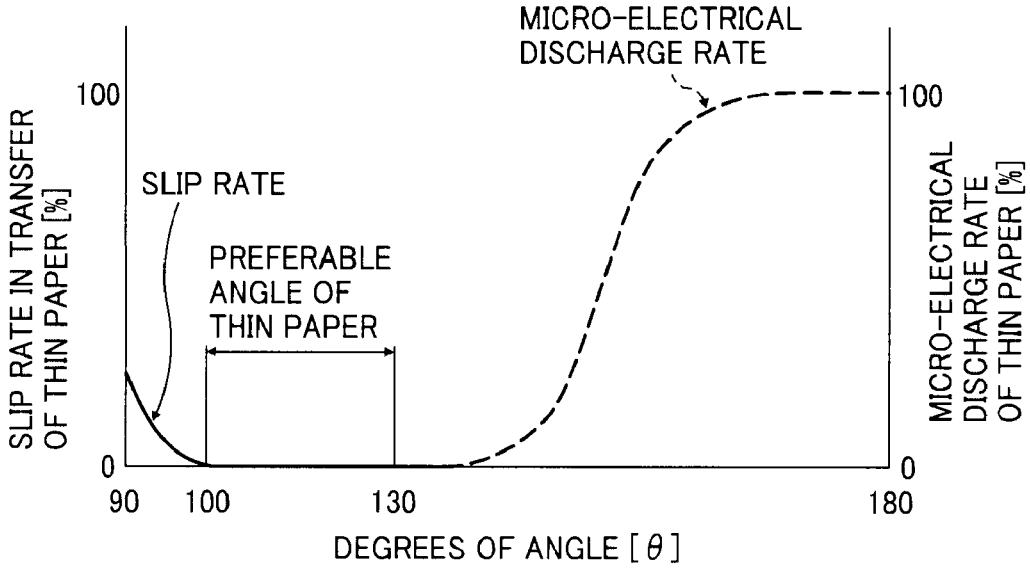
FIG. 6 is a graph illustrating a relation between the inflection angle of the conveyance belt and occurrence rate of slippage of thinner transfer sheets transported by the conveyance belt.

When the transfer sheet S is relatively thin, the relation shown in FIG. 6 can be observed. More specifically, in the case of thinner sheets having a thickness not greater than 60 g/m$^2$, for example, slip rate in transfer of thinner sheets can be lower even when the inflection angle of the conveyance belt 10 in a range in which the slip rate in transfer of thicker sheets is higher (smaller inflection angle range). When the inflection angle increases, although slip rate is lower as indicated by solid line shown in FIG. 6, adhesion of thinner sheets to the conveyance belt 10 is weakened earlier than that of thicker sheets because the rigidity of thinner sheets is lower than that of thicker sheets. Accordingly, tiny gaps are created gradually, thus increasing occurrence of micro-electrical discharging as indicated by broken lines shown in FIG. 6.

Therefore, in the case of thinner sheets shown in FIG. 6, a preferable range of inflection angle of the conveyance belt 10 in which both slip rate in transfer of the transfer sheet S and occurrence of micro-electrical discharging are reduced is from 100° to 130°, for example.

As described above, because preferred inflection angle of the conveyance belt 10 differs depending on sheet type, for example, thickness or rigidity, it is preferable that the inflection angle be adjustable according to the type of the transfer sheet S.

Now, configurations around the conveyance belt in which the first inflection angle θ1 as well as the second inflection angle θ2 are adjustable are described below.

It is to be noted that the configurations described below are similar to that of the first embodiment except the portions to make the first inflection angle θ1 as well as the second inflection angle θ2 adjustable.

(Second Embodiment)

Figure 7:
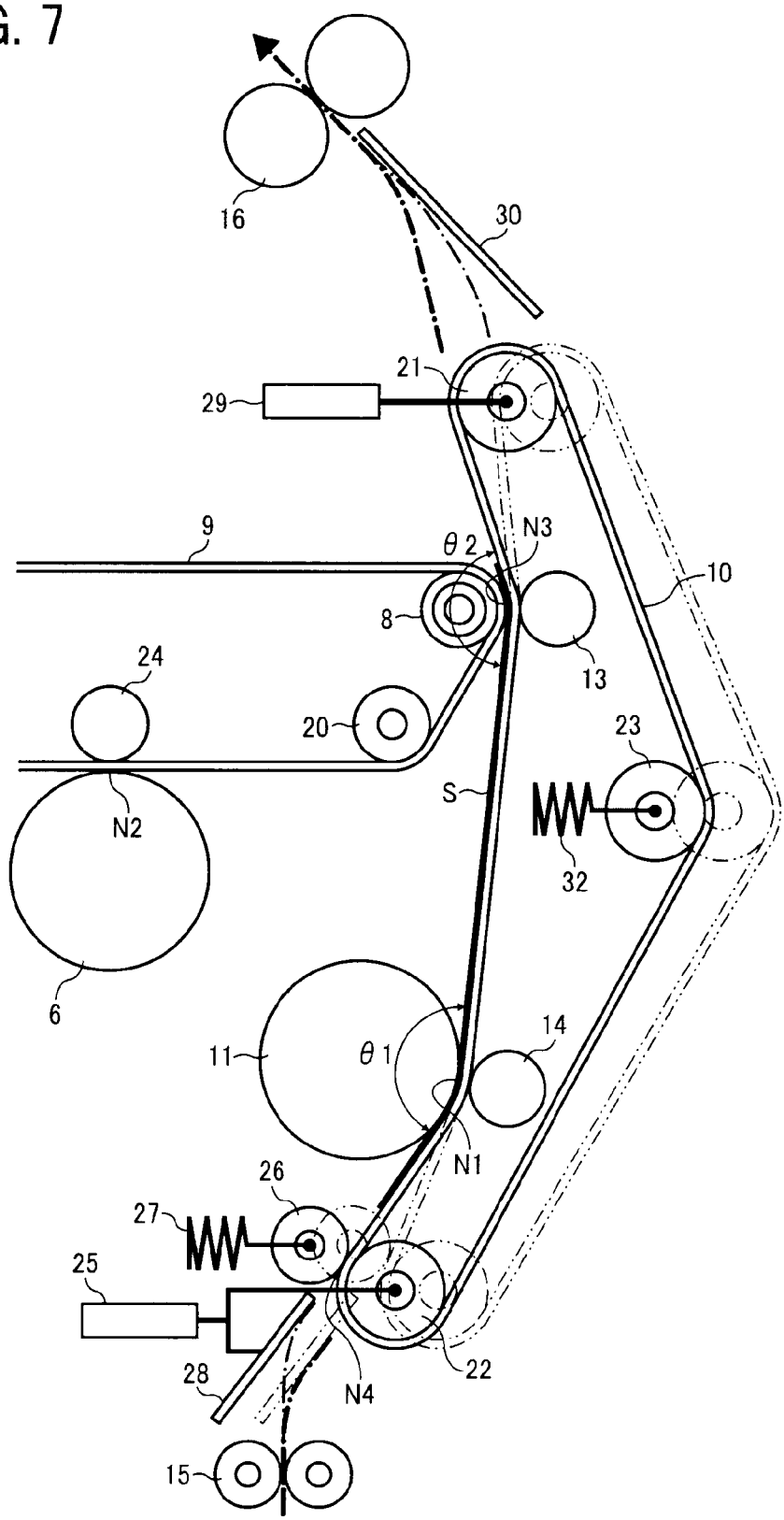
FIG. 7 is a front view schematically illustrating a configuration around a conveyance belt according to another illustrative embodiment.

FIG. 7 is a front view schematically illustrating a configuration around a conveyance belt according to the second embodiment.

As shown in FIG. 7, in the configuration around the conveyance belt according to the second embodiment, the driving roller 21 and the driven roller 22 can be moved by a solenoid to move the conveyance belt 10, thereby adjusting the first inflection angle θ1 as well as the second inflection angle θ2.

A configuration around the driving roller 21 and the driven roller 22 to move the conveyance belt 10 is described below.

A first solenoid 25 that can move reciprocally is mechanically connected to a bearing portion of the driven roller 22 to move the driven roller 22 laterally in FIG. 7. Further, a bearing portion of a conveyance roller 26 disposed facing the driven roller 22 via the conveyance belt 10 is connected via a spring 27 to a fixed portion of the apparatus so that the conveyance roller 26 can follow the movement of the driven roller 22. It is to be noted that the first solenoid 25 is electrically connected to a controller of the image forming apparatus.

Additionally, a guide 28 is provided upstream from a conveyance nip N4 formed between the conveyance roller 26 and a portion of the conveyance belt 10 winding around the driven roller 22 to guide the transfer sheet S discharged from the registration rollers 15 to the conveyance nip N4, and the guide 28 is connected to the first solenoid 25 to move in conjunction with the driven roller 22. With this configuration, the transfer sheet S can be guided reliably to the conveyance sheet S even when the conveyance nip N4 moves. It is to be noted that, alternatively, the guide 28 may be not coupled to the driven roller 28 but fixed in place when the configuration (e.g., the length, angle, position, etc.) of the guide member 28 enables reliable guide of the transfer sheet S to the conveyance nip N4.

With the above-described configuration, reciprocal movement of the first solenoid 25 causes the conveyance belt 10 to pivot in the lateral direction in FIG. 7 around the portion winding around the first photoconductor 11 on the conveyance side of the conveyance belt 10, and thus the first inflection angle θ1 is adjustable.

In the configuration around the driving roller 21, a second solenoid 29 that can move reciprocally is mechanically connected to a bearing portion of the driving roller 21 to move the driving roller 21 laterally in FIG. 7. It is to be noted that the second solenoid 29 is electrically connected to the controller of the image forming apparatus.

Further, although the angle at which the transfer sheet S is discharged (hereinafter "discharge angle") from the conveyance belt 10 changes as the driving roller 21 moves laterally in FIG. 21, a leading edge of the transfer sheet S discharged from the conveyance belt 10 contacts a guide 30 disposed between the driving roller 21 and the fixing device 16 even when the discharge angle is changed. Thus, the transfer sheet S can be guided to the fixing device 16 reliably.

With the above-described configuration, reciprocal movement of the second solenoid 29 causes the conveyance belt 10 to pivot in the lateral direction in FIG. 7 around the portion facing the secondary-transfer facing roller 8 on the conveyance side of the conveyance belt 10, and thus the second inflection angle θ2 is adjustable.

In the above-described configuration around the conveyance belt according to the second embodiment, when the transfer sheet S is thicker (the degree of rigidity is higher), the first and second solenoids 25 and 29 are operated to set the first and second inflection angles θ1 and θ2 to an angle at which both the slip rate in transfer of thicker transfer sheets and occurrence of micro-electrical discharging are lower, for example, within a range from 140° to 150°.

By contrast, when the transfer sheet S is thinner (the degree of rigidity is lower), the first and second solenoids 25 and 29 are operated to set the first and second inflection angles θ1 and θ2 to an angle at which both the slip rate in transfer of thinner transfer sheets and occurrence of micro-electrical discharging are lower, for example, within a range from 100° to 130°, for example. It is to be noted that expansion and shrinkage of a spring 32 supporting the tension roller 23 allows movement of the driving roller 21 and the driven roller 22.

In the second embodiment, the conveyance belt 10 can be moved by operating the first and second solenoids 25 and 29, thus adjusting the first and second inflection angles θ1 and θ2. Therefore, the first and second inflection angles θ1 and θ2 are adjustable according to the type of transfer sheets so that the transfer sheet can adhere to the conveyance belt 10 fully.

As described above, the configuration of the multiple rollers around which the conveyance belt 10 is stretched are not limited to those described above. For example, another driven roller may be provided at the right of the driving roller 21 and the driven roller 22, or the roller 21 may be a driven roller and one of other rollers may serve as a driving roller. Further, the shift mechanism to move the driving roller 21 and the driven roller 22 is not limited to the above-described mechanism using solenoids but can be a link mechanism, a cam mechanism, a screw mechanism, or the like.

(Third Embodiment)

FIG. 8 is a front view schematically illustrating a configuration around a conveyance belt according to the third embodiment.

As shown in FIG. 8, in the configuration around the conveyance belt according to the third embodiment, the first image forming unit 12 including the first photoconductor 11 as well as the intermediate transfer belt 9 can be moved by solenoids, and accordingly the conveyance belt 10 can be moved, thereby adjusting the first inflection angle θ1 as well as the second inflection angle θ2.

More specifically, the first image forming unit 12 including the first photoconductor 11 is mechanically connected to a third solenoid 33 so that the first photoconductor 11 can move laterally in FIG. 8. It is to be noted that the third solenoid 33 is electrically connected to the controller of the image forming apparatus.

Additionally, a spring 35 supporting the transfer roller 14 facing the first photoconductor 11 causes the transfer roller 14 to press against the first photoconductor 11. With the above-described configuration, as the third solenoid 33 moves reciprocally, the conveyance belt 10 in contact with the first photoconductor 11 is pushed and moves back around the photoconductor 11, and thus the first inflection angle θ1 is adjustable. At that time, the transfer roller 14 moves in conjunction with the conveyance belt 10.

Additionally, a fourth solenoid 34 is mechanically connected to the secondary-transfer facing roller 8 around which the intermediate transfer belt winds so that the secondary-transfer facing roller 8 can move laterally in FIG. 8. It is to be noted that the fourth solenoid 34 is electrically connected to the controller of the image forming apparatus.

Further, a spring 36 that supports the secondary-transfer roller 13, facing the secondary-transfer facing roller 8 via the intermediate transfer belt 9 as well as the conveyance belt 10, causes the secondary-transfer roller 13 to press against the secondary-transfer facing roller 8.

Moreover, although the discharge angle of the transfer sheet S changes as the secondary-transfer facing roller 8 moves laterally in FIG. 8, the leading edge of the transfer sheet S discharged from the conveyance belt 10 contacts the guide 30 disposed between the driving roller 21 and the fixing device 16 even when the discharge angle is changed. Thus, the transfer sheet S can be guided to the fixing device 16 reliably.

With the above-described configuration, as the fourth solenoid 34 moves reciprocally, the conveyance belt 10 in contact with the portion of the intermediate transfer belt 9 winding around the secondary-transfer facing roller 8 is pushed and moves, and thus the second inflection angle θ2 is adjustable. At that time, the secondary-transfer roller 13 moves in conjunction with the conveyance belt 10.

In the above-described configuration around the conveyance belt according to the third embodiment, similarly to the second embodiment, when the transfer sheet S is thicker (the degree of rigidity is higher), the third and fourth solenoids 33 and 34 are operated to set the first and second inflection angles θ1 and θ2 to an angle at which both the slip rate in transfer of thicker transfer sheets and occurrence of micro-electrical discharging are lower, for example, within a range from 140° to 150°.

By contrast, when the transfer sheet S is thinner (the degree of rigidity is lower), the third and fourth solenoids 33 and 34 are operated to set the first and second inflection angles θ1 and θ2 to an angle at which both the slip rate in transfer of thinner transfer sheets and occurrence of micro-electrical discharging are lower, for example, within a range from 100° to 130°. It is to be noted that expansion and shrinkage of the spring 32 supporting the tension roller 23 allows adjustment of the first and second inflection angles θ1 and θ2.

Thus, the first and second inflection angles θ1 and θ2 are adjustable in the third embodiment similarly to the above-described second embodiment. Therefore, the transfer sheet S can adhere to the conveyance belt 10 fully by adjusting the first and second inflection angles θ1 and θ2 according to the type of transfer sheets.

It is to be noted that the shift mechanism to move the secondary-transfer facing roller 8 to change the second inflection angle θ2 can also serve as the disengagement mechanism described in the first embodiment, to disengage the intermediate transfer belt 9 from the conveyance belt 10, as shown in FIG. 3, in monochrome printing.

It is to be noted that the multiple rollers around which the conveyance belt 10 is stretched are not limited to those described above. For example, another driven roller may be provided at the right of the driving roller 21 and the driven roller 22, or the roller 21 may be a driven roller and one of other rollers may serve as a driving roller.

Further, the shift mechanism to move the secondary-transfer facing roller 8 and the first photoconductor 11 is not limited to the above-described mechanism using solenoids but can be a link mechanism, a cam mechanism, a screw mechanism, or the like.

It is to be noted that, alternatively, the first and second inflection angles θ1 and θ2 may be adjusted using a combination of the shift mechanisms according to the second embodiment and the third embodiment. More specifically, all of the conveyance belt 10, the first photoconductor 11, and the intermediate transfer belt 9 may be shifted to change the first and second inflection angles θ1 and θ2.

For example, although the above-described embodiments concern the configuration in which the first photoconductor 11 is disposed upstream from the third transfer nip N3 formed between the secondary-transfer roller 13 and the secondary-transfer facing roller 8 in the sheet conveyance direction, the first photoconductor 11 may be disposed downstream from the third transfer nip N3.

Additionally, although the above-described embodiments concern the configuration in which the conveyance belt 10 extends vertically, the conveyance belt 10 may extend horizontally with the intermediate transfer belt 9 extending vertically. In other words, the above-described first through third embodiments are also applicable in a configuration in which transfer sheets are transported horizontally although more effective when applied in the configuration in which transfer sheets are transported vertically.

Moreover, although the above-described embodiments concern the configuration in which the conveyance belt 10 is inflected at two positions, the conveyance belt 10 may be inflected at only a single position to facilitate reliable sheet conveyance with slippage as well as jamming of sheets reduced.

Thus, according to the above-described configuration, transporting the transfer sheet by the inwardly curved conveyance belt can enhance adhesion of the transfer sheet to the conveyance belt with resilience due to rigidity of the transfer sheet. Therefore, slippage of the transfer sheet can be prevented, and jamming of sheets can be reduced. Additionally, possibility of creation of tiny gaps, which invite electrical discharging and image failure resulting from it can be eliminated or reduced.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

a first image carrier on which a first toner image is formed;

a second image carrier on which a second toner image is formed;

an intermediate transfer member disposed facing the second image carrier, to transport the second toner image;

a conveyance belt to transport a transfer sheet from upstream to downstream, disposed facing both the first image carrier and the intermediate transfer member and winding around at least a first support roller and a second support roller, downstream from the first support roller;

a first transfer member disposed facing the first image carrier via the conveyance belt, to transfer the first toner image from the first image carrier onto the transfer sheet transported by the conveyance belt;

a second transfer member disposed facing the second image carrier, to transfer the second toner image from the second image carrier onto the intermediate transfer member; and a third transfer member disposed downstream from the second image carrier in a direction in which the intermediate transfer member rotates, to transfer the second toner image from the intermediate transfer member onto the transfer sheet transported by the conveyance belt;

the first image carrier inflecting the conveyance belt at a first inflection angle, the intermediate transfer member inflecting the conveyance belt at a second inflection angle, wherein a horizontal direction is along the intermediate transfer member, and a tangent is defined between a first point on the first support roller with a shortest horizontal distance to the first image carrier, and a second point on the second support roller with the shortest horizontal distance to the first image carrier, the conveyance belt being on a side of the tangent furthest away from the intermediate transfer member.

2. The image forming apparatus according to claim 1, further comprising a first shift mechanism to change the first inflection angle as well as the second inflection angle by moving the conveyance belt relative to the first image carrier and the intermediate transfer member.

3. The image forming apparatus according to claim 2, wherein the first shift mechanism comprises:

a first solenoid connected to the first support roller to move the first support roller; and a second solenoid connected to the second support roller to move the second support roller, wherein the first support roller and the second support roller are respectively disposed upstream and downstream from the first image carrier as well as the third transfer member in a sheet conveyance direction in which the transfer sheet is transported.

4. The image forming apparatus according to claim 1, further comprising a second shift mechanism to change the first inflection angle as well as the second inflection angle by moving the first image carrier and the intermediate transfer belt relative to the conveyance belt.

5. The image forming apparatus according to claim 4, further comprising a secondary-transfer facing roller disposed facing the third transfer member via the conveyance belt, and the second shift mechanism comprises a third solenoid connected to the first image carrier, to move the first image carrier, and a fourth solenoid connected to the secondary-transfer facing roller, to move the secondary-transfer facing roller.

6. The image forming apparatus according to claim 5, wherein the second shift mechanism moves the conveyance belt in addition to the first image carrier and the intermediate transfer member.

7. The image forming apparatus according to claim 1, further comprising a disengagement member to engage and disengage the intermediate transfer member and the conveyance belt from each other.

8. The image forming apparatus according to claim 1, wherein a conveyance velocity of the conveyance belt is faster than a conveyance velocity of the intermediate transfer member and a conveyance velocity of the first image carrier.

9. The image forming apparatus according to claim 1, wherein a surface frictional coefficient of the conveyance belt is greater than a surface frictional coefficient of the intermediate transfer member and a surface frictional coefficient of the first image carrier.

10. The image forming apparatus according to claim 1, further comprising a secondary-transfer facing roller disposed facing the third transfer member via the conveyance belt, wherein the secondary-transfer facing roller has a degree of hardness lower than that of the third transfer member, and the intermediate transfer member is an endless belt winding around the secondary-transfer facing roller and multiple support rollers.

11. The image forming apparatus according to claim 10, wherein the secondary-transfer facing roller comprises an elastic surface layer.

12. The image forming apparatus according to claim 1, wherein a first section of the conveyance belt is between the first support roller and the first transfer member;

a second section of the conveyance belt is between the first transfer member and the third transfer member;

a third section of the conveyance belt is between the third transfer member and the second support roller;

the first inflection angle is external to the conveyance belt between the first section and second section of the conveyance belt; and the second inflection angle is external to the conveyance belt between the second section and third section of the conveyance belt.

* * * * *